US005100252A

United States Patent [19]

Podolsky

[11] Patent Number: 5,100,252

[45] Date of Patent: Mar. 31, 1992

[54] TOOTHBRUSH

[76] Inventor: Grigory Podolsky, 35-53 82 St., Jackson Heights, N.Y. 11372

[21] Appl. No.: 547,019

[22] Filed: Jul. 2, 1990

[51] Int. Cl.[5] ..... A46B 11/02

[52] U.S. Cl. ..... 401/174; 401/271; 401/278; 401/286; 401/288

[58] Field of Search ..... 401/271, 288, 174, 69, 401/186, 278, 286

[56] References Cited

U.S. PATENT DOCUMENTS

| | | | |
|---|---|---|---|
| 1,860,911 | 5/1932 | Trimble | 401/174 |
| 1,988,557 | 1/1935 | Jecker | 401/271 |
| 2,018,158 | 10/1935 | Violette | 401/174 |
| 3,256,894 | 6/1966 | Sherman | 401/278 X |
| 3,545,874 | 12/1970 | Schwartzman | 401/186 |

FOREIGN PATENT DOCUMENTS

| | | | |
|---|---|---|---|
| 1178036 | 9/1964 | Fed. Rep. of Germany | 401/186 |
| 669856 | 8/1929 | France | 401/174 |
| 1098701 | 8/1955 | France | 401/69 |
| 275977 | 9/1951 | Switzerland | 401/174 |
| 285808 | 1/1953 | Switzerland | 401/174 |

*Primary Examiner*—Steven A. Bratlie

[57] ABSTRACT

A toothbrush comprises a toothbrushing part having a head provided with a plurality of bristles and a passage extending to the bristles, a toothpaste container part connected with the toothbrushing part and adapted to contain a quantity of toothpaste, piston means arranged to press the paste from the toothpaste container part into the toothbrushing part, and valve means arranged in the head of the toothbrushing part movably so that when the piston means press out the toothpaste from the toothpaste container part into the toothbrushing part the valve means is displaced in the passage toward an outer surface of the bristles so as to apply the toothpaste onto the outer surface of the bristles, while when the piston means is retracted and a negative pressure is produced in the toothbrushing part the valve means is withdrawn from the outer surfaces of the bristles so as not to hinder brushing of teeth by the outer surface of the bristles.

6 Claims, 2 Drawing Sheets 10
10
FIG. 6. c 11
8
11
9

4
5
6
14
12
13

1
2
14
3

12
13
15
16
17
18
19
20
21
22
23
24
25
26
27
2

TOOTHBRUSH

BACKGROUND OF THE INVENTION

The present invention relates to a toothbrush in general and particularly to a toothbrush having a toothpaste container associated with the toothbrushing part.

Toothbrushes of the above mentioned general type are known in the art. They generally have a complicated construction and are rather long. It is believed that it is desirable further improve the construction and the operation of existing toothbrushes.

SUMMARY OF THE INVENTION

Accordingly, it is an object of the present invention to provide a toothbrush which is a further improvement of existing toothbrushes and accommodates in it both a toothbrushing part and a toothpaste supplying part.

In keeping with these objects and with others which will become apparent hereinafter, one feature of the present invention resides, briefly stated, in a toothbrush which has a toothbrushing part with a head provided with a plurality of bristles, a toothpaste container connected with the toothbrushing part for supplying a toothpaste to the toothbrushing part and to the head with the bristles, and valve means arranged so that during supplying the toothpaste onto the bristles the valve means is opened and located between the bristles, and for brushing with the bristles the valve means is withdrawn from the region of the bristles so as not to interfere with the teeth during brushing by the bristles.

In accordance with another feature of the present invention, the toothbrush is provided with means for supplying the toothpaste and including a piston which is formed as a multi-stage piston with several piston portions axially telescopically insertable in one another to reduce the overall length of the toothbrush.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a front view of a toothbrush in accordance with the present invention;

FIG. 2 is a side view of the inventive toothbrush;

FIG. 3 is a rear view of the inventive toothbrush;

FIG. 4 is a plan view of the toothbrush without a toothbrushing portion;

FIG. 5*a* is a view showing a section of the rear end of the toothbrushing portion;

FIG. 5*b* is a view showing a section of a front end of a toothpaste container portion;

FIG. 6*a* shows valve means in an open condition, while FIGS. 6*b*, 6*c*, 6*d* show the valve means in a closed condition from a side view, a front view, and a plan view, respectively;

FIGS. 7*a*, 7*b* and 7*c* are views showing sections taken through the toothbrushing portion in the lower, central and upper regions;

DESCRIPTION OF THE PREFERRED EMBODIMENT

Figures 1, 2, 3, 4, 5A, 5B, 6A, 6B, 6D, 7A, 7B, 7C:
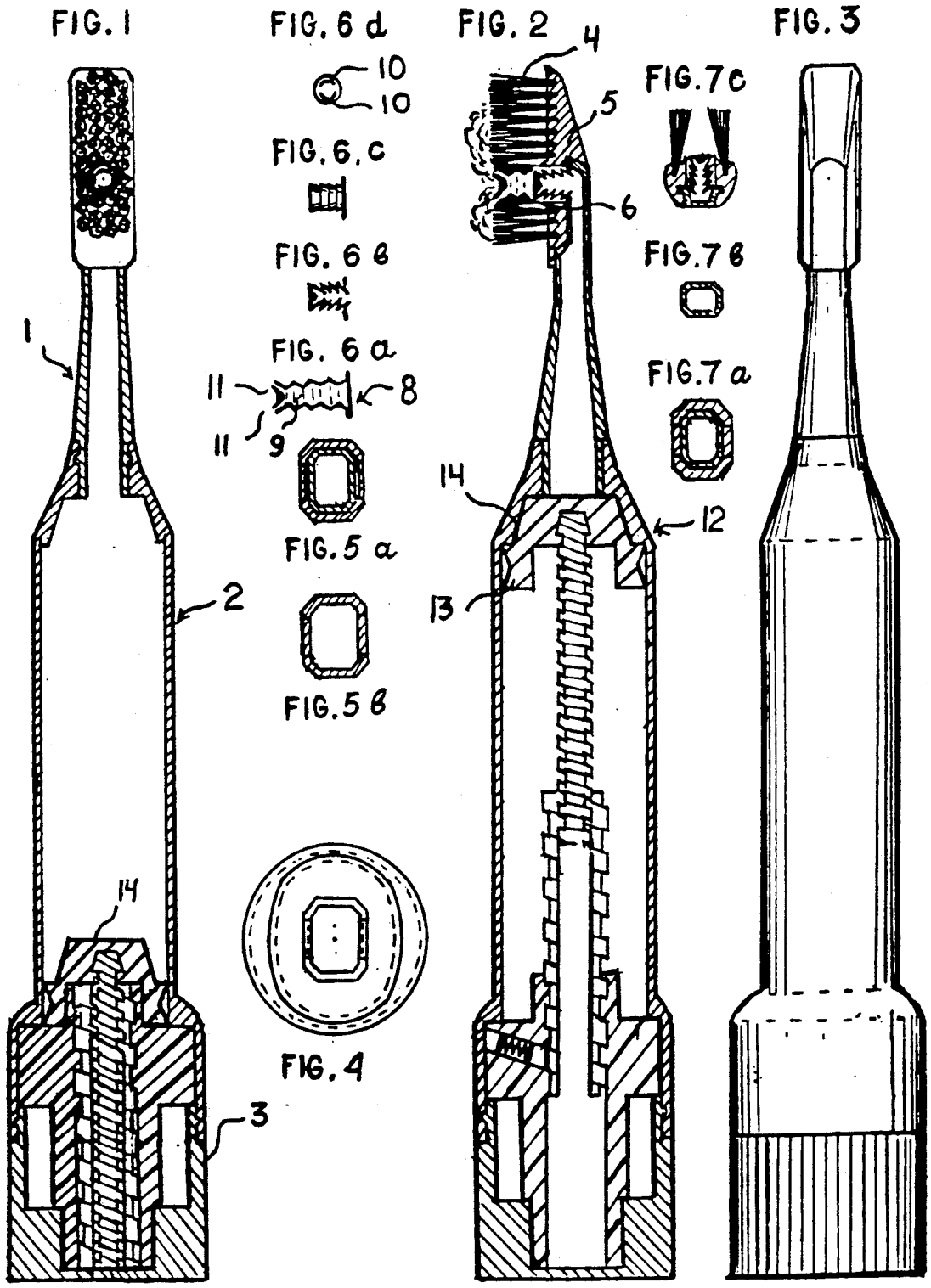
Figures 8, 9, 10, 11, 11A, 11B, 11C, 11D, 12A, 12B:
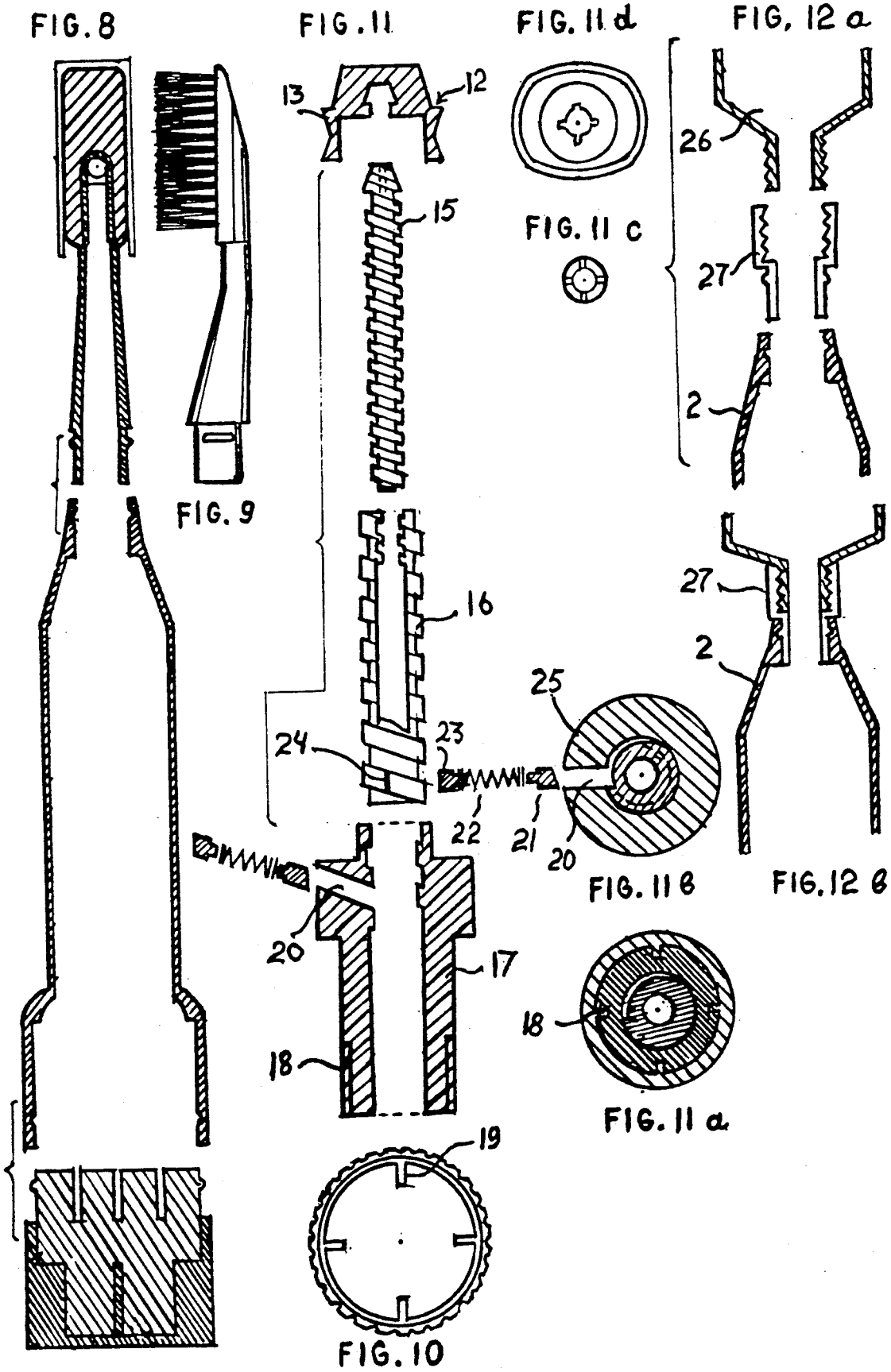
FIG. 8 is an exploded view of the toothbrushing portion, the toothpaste container portion, and the handle portion of the toothbrush.
FIG. 9 is a side view of the toothbrushing portion with a hood.
FIG. 10 is a plan view of the handle of the toothbrush.
FIG. 11 is an exploded view of a toothpaste supplying piston of the toothbrush.
FIGS. 11*a*, 11*b*, 11*c*, 11*d* show cross-sections of respective parts of the piston.
FIGS. 12*a* and 12*b* show the process of supplying a toothpaste into the toothbrush in an exploded view and in assembled condition, respectively.

A toothbrush in accordance with the present invention has a toothbrushing part which is identified as a whole with reference numeral 1, a toothpaste container part which is identified with reference numeral 2, and a handle which is identified with reference numeral 3. The lower end of the toothbrushing part 1 is connected with the upper end of the toothpaste container part 2 by interengaging projections and grooves shown in FIGS. 5*a* and 5*b*. The toothpaste container part 2 has a substantially oval shape as shown in FIG. 4.

The toothbrushing part 1 has a head provided with a plurality of bristles 4. Valve means 5 is located in the head of the toothbrushing part 1. The valve means 5 include projections 6 formed in the head and defining an extension of a passage 7 provided in the head. A valve body 8 is movable in the passage and has an expansible and compressible bellows-like main portion 9 with an end provided with two openings 10 and two flaps 11. The flaps 11 in a normal position when no force is applied close, the openings 10. The main portion 9 is fixedly received in the passage 7.

The toothbrush has further piston means 12 movable in the toothpaste container portion 2. The piston means includes a piston 13 with a top portion 14 which can be provided with a special shape. The piston has an oval shape and is connected with a piston rod composed of an upper part 15, a central part 16 and a lower part 17. The upper part 15 of the piston rod is clampingly engageable in the piston 13 since it has a split expansible and contractible upper head. The upper part 15 is provided with an outer thread cooperating with an inner thread of the central part 16. The central part 16 is provided with an outer thread cooperating with an inner thread of the lower part 17. The lower part 17 has slots 18, in which the projections 19 of the handle 3 are inserted. The lower part 17 of the piston rod has a passage 20, in which locking means is engageable. The locking means includes a piece 21, a spring 22 and a stop means 23. This locking means is used for locking the central part 16 in the lower part 17 and unlocking the former from the latter. For this purpose, the central portion 16 has a recess 24. Also a locking element 25 is provided. The toothbrush is also provided with a removable hood 26.

The operation of the toothbrush is performed in the following manner. By turning the handle 3 and thereby the lower portion 17 of the piston rod, the central portion of the piston rod 16 together with the upper portion of the central rod 15 is screwed out from the lower portion 17 as shown in FIG. 3. In the upper end position, the locking elements engage in the recess 24 and stop the central part 16 of the piston rod from further axial displacement. During further turning of the handle 3 and now both the lower part 17 and the central part 16 of the piston rod, the upper part 15 of the piston rod is screwed out of the central part 16 until the piston 13 abuts with its conical part 14 against the walls of the conical upper part of the toothpaste container part 2. The toothpaste is pressed from the toothpaste container part 2 into the toothbrushing part 1. The special shape prevents sliding of the toothpaste downwardly along the cone and pressing of the paste against the edges of the piston. Under the action of the piston, the toothpaste is pressed from the toothpaste container 2 into the toothbrushing part 1. Under the action of the pressure applied by the paste the main part 9 of the valve means 8 is stretched to the left and its left end extends leftwardly beyond the projections 6. The paste is squeezed through the inner passage of the main part 9 and spreads the flaps 11 apart so as to exit through the openings 10 onto the surface of the bristles 4. When the handle 3 is turned in the opposite direction so as to pull the piston rod with the piston 13 downwardly and a negative pressure is formed in the passage of the toothbrushing part 1. Since the flaps are normally urged toward the openings 10 to close them, in condition of the negative pressure they close the openings 10 and the main part 9 of the valve means 8 is pulled to the right back into the passage 7, so that the left end of the valve means 8 is withdrawn from the are of the brushing surface of the bristles 4. In this position the toothbrush can be used for brushing teeth. Its is to be understood that during further turning of the handle, the piston rod is shortened by insertion of the upper part 15 into the central part 16 and the central part 16 into the lower part 17. The locking means is formed so as not to hinder such an insertion.

For filling the toothpaste container part 2 with the toothpaste, the toothbrushing part 1 is removed and a toothpaste container 28 is connected with the toothpaste container part 2 through an intermediate bush 27. The toothpaste container part 2 is squeezed and supplies a toothpaste into the toothpaste container part 2 of the toothbrush.

The present invention is not limited to the details shown, since various modifications and structural changes are possible without departing in any wa from the spirit of the present invention.

What is desired to be protected by Letters Patent is set forth in the appended claims.

I claim:

1. A toothbrush, comprising a toothbrushing part having a head provided with a plurality of bristles and a passage extending to said bristles; a toothpaste container part connected with said toothbrushing part and adapted to contain a quantity of toothpaste; piston means arranged to press the paste from said toothpaste container part into said toothbrushing part; and valve means arranged in said head of said toothbrushing part movably so that when said piston means press out the toothpaste from said toothpaste container part into said toothbrushing part said valve means is displaced in said passage toward an outer surface of said bristles so as to apply the toothpaste onto the outer surface of the bristles, while when said piston means is retracted and a negative pressure is produced in said toothbrushing part said valve means is withdrawn from said outer surface of said bristles so as not to hinder brushing of teeth by the outer surface of said bristles, said valve means including projections formed in said head and defining an extension of said passage, a bellow-like main part having an end provided with two oppositely located openings and two flaps urged toward said opening so as to close said opening in the absence of a pressure and withdrawals from said opening so as to open said openings under the action of the toothpaste pressed out by said piston means from said toothpaste container part to said toothbrushing part through said passage, said bellow-like main part of said valve means being stretchable under the action of the toothpaste pressed out from said toothpaste container part into said toothbrushing part and through said passage so that an end of said main part extends outwardly of said extension of said passage and beyond said projections to extend to said upper surface of said bristles and then compressible under the action of negative pressure in said toothbrushing part so that said end of said end of said main part is withdrawn inwardly of said extension of said passage.

2. A toothbrush as defined in claim 1, wherein said valve means includes a bellows-like main part having an end provided with at least one opening, and at least one flap urged toward said opening so as to close said opening in the absence of a pressure and withdrawable from said opening so as to open said opening under the action of the toothpaste pressed out by said piston means from said toothpaste container part to said toothbrushing part through said passage.

3. A toothbrush as defined in claim 2, wherein said bellows-like main part of said valve means is stretchable under the action of the toothpaste pressed out from said toothpaste container part into said toothbrushing part and through said passage to extend to said upper surface of said bristles, and then compressible under the action of the negative pressure in said toothbrushing part.

4. A toothbrush as defined in claim 1, wherein said piston means includes a piston and a piston rod connected with said piston and having a plurality of parts telescopeably insertable in one another; and further comprising a handle, one of said parts of said piston rod being connected with said piston, while the other of said parts of said piston rod is connected with said handle so that under the action of turning of said handle said parts are telescopeably insertable in one another and telescopeably extendable from one another.

5. A toothbrush as defined in claim 4, wherein said parts of said piston rod are provided with cooperating threads so that during turning of said handle said parts of said piston rod are screwable in one another and screwable out of one another.

6. A toothbrush, comprising a toothbrushing part having a head provided with a plurality of bristles and a passage extending to said bristles; a toothpaste container part connected with said toothbrushing part and adapted to contain a quantity of toothpaste; piston means arranged to press the paste from said toothpaste container part into said toothbrushing part; and valve means arranged in said head of said toothbrushing part movably so that when said piston means press out the toothpaste from said toothpaste container part into said toothbrushing part said valve means is displaced in said passage toward an outer surface of said bristles so as to apply the toothpaste onto the outer surface of the bristles, while when said piston means is retracted and a negative pressure is produced in said toothbrushing part said valve means is withdrawn from said outer surface of said bristles so as not to hinder brushing of teeth by the outer surface of said bristles, said piston means including a piston and a piston rod connected with said piston and having a plurality of parts telescopeably insertable in one another; and further comprising a handle. one of said parts of said piston rod being connected with said piston, while the other of said parts of said piston rod is connected with said handle so that under the action of turning of said handle said parts are telescopeably insertable in one another and telescopeably extendable from one another, said parts of said piston rod are provided with cooperating threads so that during turning of said handle said parts of said piston rod are screwable in one another and screwable out of one another.

* * * * *